United States Patent [19]

Lofquist, Jr.

[11] Patent Number: 4,637,784

[45] Date of Patent: Jan. 20, 1987

[54] METERING PUMP WITH DIAPHRAGM

[76] Inventor: Alden A. Lofquist, Jr., 10609 Farragut Hills Blvd., Knoxville, Tenn. 37922

[21] Appl. No.: 787,499

[22] Filed: Oct. 15, 1985

[51] Int. Cl.[4] ..... F04B 19/14; F01D 23/00; F03B 9/00

[52] U.S. Cl. ..... 417/320; 417/251; 417/572

[58] Field of Search ..... 92/89, 90, 93, 96; 417/320, 251, 287, 425, 572

[56] References Cited

U.S. PATENT DOCUMENTS 3,859,010 1/1975 Loftquist ..... 417/321

3,924,973 12/1975 Loftquist ..... 417/320

*Primary Examiner*—Leonard E. Smith

*Attorney, Agent, or Firm*—Luedeka & Neely

[57] ABSTRACT

There is disclosed a metering pump for metering and pumping small volumes of fluid. A continuous member with annular elements carries pumping fluid through a first passageway containing a diaphragm which defines a second passageway. Provision is made for changing the pressure of the pumping fluid being carried through the passageway. This causes the diaphragm to expand into the first passageway drawing fluid to be pumped into one end of the second passageway. The pumped fluid is then carried through the second passageway by movement of the continuous member with annular elements along the first passageway and delivered out of the other end of the second passageway.

13 Claims, 6 Drawing Figures

METERING PUMP WITH DIAPHRAGM

The present invention relates to improvements in the design and construction of positive displacement pumps and metering devices of the type disclosed in U.S. Pat. Nos. 3,859,010 and 3,924,973 in which a continuous member with annular elements is drawn through axially aligned bores or passageways of various cross sectional areas, and more specifically relates to the incorporation of a diaphragm within one of those passageways to separate the fluids being pumped or involved in the pumping function.

In accordance with the present invention, an apparatus for metering small volumes of fluids is disclosed having a first elongated passageway with open ends. Fluid is carried through the first passageway by means of a plurality of spaced-apart elements proportioned to sealingly engage the wall defining the first passageway. The spaced-apart elements are interconnected for movement through the first passageway from one end of the passageway to the other. An improvement is disclosed comprising an elongate, flexible, fluid impermeable membrane in the first passageway having marginal edges sealingly attached to the wall defining the first passageway to provide a second elongate passageway extending along at least a portion of the length of the first passageway. An inlet opening is provided in the wall defining the first passageway for connecting the second passageway with a source of fluid to be pumped. A first outlet opening in the wall defining the first passageway delivers pumped fluid from the second passageway. The inlet opening to the second passageway is positioned towards one end of the first passageway, and the first outlet opening is spaced from the inlet opening toward the other end of the first passageway. Pumping fluid is supplied to the first passageway by means of the spaced-apart elements moving through the first passageway. Structure is provided for reducing the pressure of the pumping fluid between the spaced-apart elements adjacent the inlet opening to the second passageway and for increasing the pressure of the pumping fluid between the spaced-apart elements adjacent the first outlet opening from the second passageway, whereby pumped fluid is drawn into the inlet opening of the second passageway, carried along the second passageway, and forced out of the first outlet opening from the second passageway.

In accordance with another aspect of the present invention the pressure of the pumping fluid is reduced by means of a first transition area in the first passageway for increasing the cross sectional area of the first passageway adjacent the inlet opening to the second passageway. The pressure of the pumping fluid is increased by means of a second transition area in the first passageway reducing the cross sectional area of the first passageway adjacent the first outlet opening from the second passageway.

In accordance with yet another aspect of the present invention, the pressure of the pumping fluid is reduced by means of a pump for withdrawing a portion of the pumping fluid passing through the first passageway adjacent the inlet opening to the second passageway. The pressure of the pumping fluid is increased by means of a pump adding fluid to the pumping fluid passing through the first passageway adjacent the first outlet opening from the second passageway.

In accordance with still another aspect of the present invention, an apparatus is disclosed for metering small volumes of fluid which comprises a pump housing having a first fluid space and a second fluid space, and a wall separating the first fluid space from the second fluid space. A first inlet opening passes fluid into the first fluid space and a first outlet opening delivers fluid from the second fluid space. A first pump located in the wall pumps fluid from the first fluid space to the second fluid space and a second pump located in the wall pumps fluid from the second fluid space to the first fluid space at a slower rate than the first pump is pumping fluid from the first fluid space to the second fluid space. In this manner, the second fluid space is pressurized relative to the first fluid space, whereby fluid flows through the outlet opening out of the second fluid space and through the first inlet opening into the first fluid space.

In accordance with a further aspect of the present invention, the first and second pumps comprise first and second pump blocks, respectively, with the first pump block having a wall defining a first passageway for connecting the first fluid space with the second fluid space, and the second pump block having a wall defining a passageway with a smaller cross sectional area than the cross sectional area of the first passageway in the first pump block for connecting the second fluid space with the first fluid space. A continuous member having spaced-apart elements attached thereto is operable to be drawn through the first passageway in the first pump block to transfer fluid from the first fluid space to the second fluid space, and through the passageway in the second pump block to transfer fluid from the second fluid space to the first fluid space. The spaced-apart elements are dimensioned to sealingly engage the walls of the passageways in the first and second pump blocks. Structure is provided for moving the continuous member and spaced-apart elements through the passageways in the first and second pump blocks.

In accordance with an additional aspect of the present invention the flow of fluid into the first fluid space and out of the second fluid space is regulated. An elongate, flexible, fluid impermeable membrane is attached to the wall defining the first passageway in the first pump block to provide a second passageway having opposite ends, with the second passageway extending at least along a portion of the length of the first passageway. Structure is provided for admitting fluid from a fluid source into the second passageway towards one end of the second passageway and for delivering fluid from the second passageway spaced from the admitting structure towards the other end of the second passageway. The membrane is configured to be expandable into the first passageway in the first pump block so that when the flow of fluid into and out of the first and second fluid spaces is prevented, the membrane expands into the first passageway to restrict the flow of fluid through the first passageway to decrease the volume of fluid flowing through the first passageway into the fluid space until it equals the volume of fluid flowing through the passageway of the second pump block into the first fluid space, whereby fluid is admitted into the second passageway at one end, carried along the second passageway, and forced out of the second passageway at the other end.

The advantages and further aspects of the present invention will be readily appreciated by those of ordinary skill in the art as the same becomes better understood by reference to the following detailed description when considered in conjunction with the accompanying drawings in which.

Figure 1:
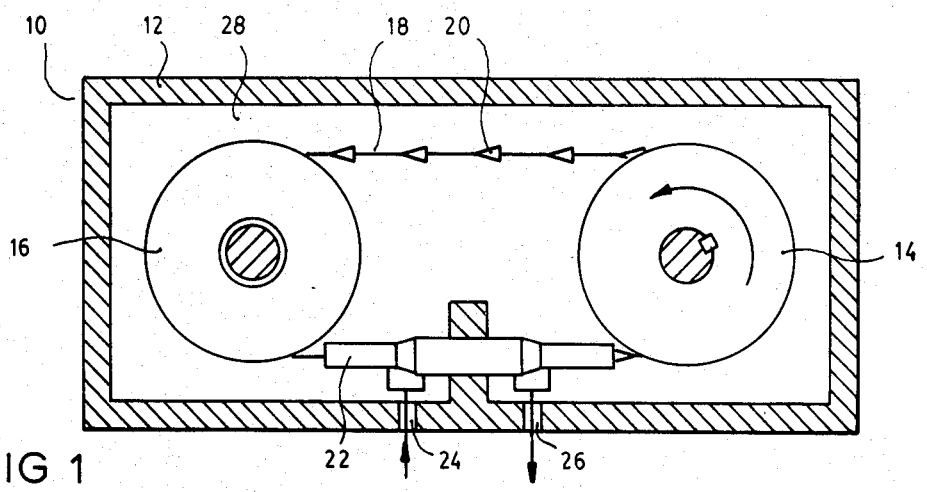
FIG. 1 is a sectional plan view of one preferred embodiment of the metering pump according to the invention having a pumping block containing a diaphragm, and a continuous member having spaced-apart annular elements.
Figure 2:
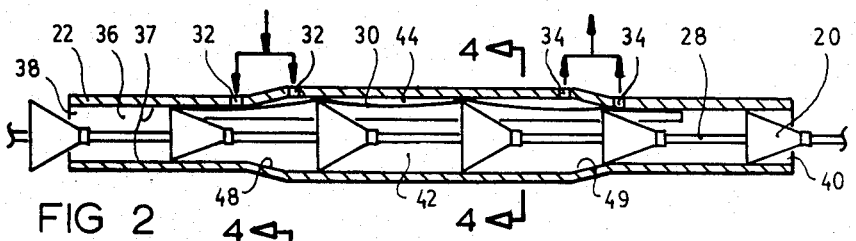
FIG. 2 is a sectional view along the longitudinal axis of the pumping block shown in FIG. 1, illustrating several views of the functional elements in greater detail.

Referring now to the drawings in which like reference characters refer to like or similar parts throughout the several views, there is shown in FIGS. 1 and 2 a metering pump 10 incorporating several aspects of a preferred embodiment of the present invention comprising a pump housing 12 containing first and second sheaves 14 and 16 over which a continuous member 18 with annular elements 20 travels, a pump block 22, inlet and outlet fluid passageways 24 and 26 respectively, and a pumping fluid space 28. The first sheave 14 is rigidly connected to a drive shaft which in turn is actuated by some drive means (not shown) external to the pump housing 12. The second sheave 16 is configured with a bushing to rotate freely about a fixed shaft, but may under some conditions be synchronously driven with the first sheave 14. The pump block 22 contains a diaphragm 30, shown in detail in FIG. 2, and inlet openings 32 and outlet openings 34 which are connected by suitable piping or tubing sealably passing through inlet and outlet passageways 24 and 26 to a source of pumped-fluid located outside the pump housing 12.

A first elongate passageway 36 is defined by an inside wall 37 of the preferred form of the pump block 22 shown in FIG. 2. Inlet and outlet open ends 38 and 40, respectively, terminate the first passageway 36 at opposite ends of the pump block 22. A preferred means for transporting pumping fluid through the first passageway 36 is provided by the continuous member 18 with annular elements 20 shown moving though the first passageway 36. The continuous member 18 can be of a finite length and may reverse its direction of travel. The spaced-apart elements 20 are proportioned radially to sealingly engage the wall 37 of the first passageway 36 generally along the length of the pump block 22. A preferred form of the elements 20 as illustrated in FIG. 2 involves the use of flexible cones which are circumferentially compressible and expandable (see change in form of the elements 20 as they pass through the pump block 22 in FIG. 2). The perimeter of the elements 20 is selected to be slightly greater than the largest possible perimeter of the passageway 36 so that the circumferential edge of each element 20 will at all times be in engagement with the wall 37, either through direct contact or by indirect contact such as by first engaging the diaphragm 30 and pressing it against the wall 37.

The diaphragm 30 is installed in the first passageway so as to form a second passageway 44 between the diaphragm 30 and the wall 37 of the first passageway 36. The second passageway 44 extends longitudinally to communicate with all of the inlet and outlet openings 32 and 34. Different methods of installing and attaching the diaphragm 30 may be employed including adhesives where applicable and also clamping between segments of the pump block 22 if the pump block 22 is appropriately segmented.

Additionally, the diaphragm 30 may vary from full circumferential coverage of the first passageway 36 of the pump block 22 to only an arc segment, and may be attached so as to form more than one fluid flow channel. The diaphragm 30 is preferably formed using a flexible, fluid impermeable, membrane sealably attached as by its marginal edges 46 to the wall 37 of the first passageway (see FIG. 4) and at its opposite longitudinal ends. Should the diaphragm 30 have a tubular shape instead of the arc shown in the FIGURES, the marginal edge to be attached to the wall 37 would be at opposite longitudinal ends of the diaphragm 30. A series of pumping fluid sections 42 are defined between the successive annular elements 20 and the wall 37 of the first passageway 36. The elements 20 are separated one from another by a distance less than the distance between the open inlet end 38 of the first passageway 36 and the inlet openings 32 to define the volume of the pumping fluid sections 42 upon entrance into the pump block 22. And the inlet openings 32 and outlet openings 34 are spaced-apart by a distance greater than the separation between the elements 20 so that a pumping fluid section 42 will completely pass the inlet openings 32 before reaching the outlet openings 34.

The pumping fluid contained in a pumping fluid section 42 has been drawn from the fluid space 28 by motion of the continuous member 18 and annular elements 20 moving into the open inlet 38 of the pump block 22. As shown in FIG. 2, when the continuous member 18 with annular elements 20 is drawn through the passageway 36 of the pump block 22 from left to right, it first traverses a section of reduced cross sectional area, then a section of full cross sectional area, and finally a section of reduced cross sectional area. A transition of increasing cross sectional area 48 provides a preferred means for reducing the pressure of a pumping fluid section 42 passing adjacent the inlet openings 32 which is accomplished as the previously defined volume of a fluid section 42 encounters the larger cross sectional area with a fixed distance between the annular elements 20. As a pumping fluid section 42 enters the increased cross sectional area 48, any decrease in pressure is compensated in a dynamic manner by movement of the diaphragm 30 away from the inlet openings 32 and a consequent drawing of fluid to be pumped into the inlet openings 32 and into the second passageway 44 adjacent the inlet openings 32. The fluid drawn into the second passageway 44 is then captured as the annular elements 20 move by the part of the diaphragm 30 adjacent the inlet openings 32. Continued movement of the annular elements 20 carries the fluid captured in the second passageway 44 along the second passageway 44 to the area of decreasing cross sectional area 49 which provides a preferred means for increasing the pressure of a pumping fluid section 42 passing adjacent the outlet openings 34. The increase in pressure occurs as the pumping fluid section 42 and volume of pumped fluid captured in the second passageway 44 encounter the transition of decreasing cross sectional area 49 with a fixed distance between the annular elements 20, which causes the diaphragm 30 to be moved in the direction of the outlet outlet openings 34 to force the captured fluid out of the openings 34. And movement of the annular element 20 enclosing the back of the pumping fluid section 42 through the first passageway 36, by pressing the diaphragm 30 against the wall 37 as shown, insures that all the fluid captured in the second passageway 44 will be delivered out of the second passageway 44 at the outlets 34 as the annular element 20 "wipes" the wall 37 when it passes by the part of the diaphragm 30 adjacent the outlets 34. The original fluid volume contained in the pumping fluid section 42 is finally passed out the open outlet end 40 of the first passageway 36 to the fluid space 28 from which it was drawn.

Figure 3:
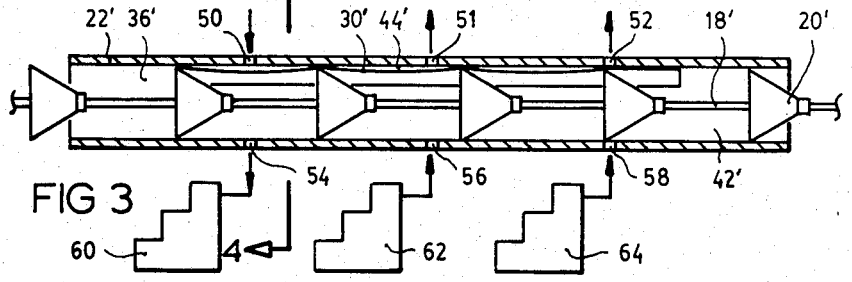
FIG. 3 is a sectional view of another embodiment of the pumping block containing a diaphragm, employing multiple pumped fluid inlet and outlet passageways, and using external pumping means to vary the volume of pumping fluid within the pumping block and between adjacent annular elements.

FIG. 3 shows an alternate preferred embodiment of the present invention in which a pump block 22' has a constant cross sectional area with a diaphragm 30' attached within a first passageway 36' to form a second passageway 44' in a similar manner to that described above with respect to FIG. 2. An inlet openings 50 and a pair of outlet opening 52 are provided for communicating with the source of pumped fluid within the geometrical confines of the diaphragm 30'. Diametrically opposite the openings for the pumped fluid are passageways 54, 56 and 58 communicating via piping or tubing (not shown) with fluid pumps 60, 62 and 64 located outside the pump housing 12. The fluid pump 60 is operable to draw a portion of a pumping fluid section 42' passing by the passageway 54 out of the first passageway 36'. The result is a decrease in pressure adjacent the inlet opening 50 producing the same result as described above relative to the transition of increasing cross sectional area 48 of FIG. 2. Similarly, fluid pumps 62 and 64 are operable to add an amount of fluid to the pumping fluid section 42' passing by passageways 56 and 58 to increase the pressure adjacent the outlet openings 52 to force pumped fluid out of the second passageway 44'. This same result was described above relative to the transition of decreasing cross sectional area 49 in FIG. 2. Thus, it is seen that FIGS. 2 and 3 illustrate alternate preferred means for reducing the pressure of the pumping fluid adjacent the inlet openings 32 or 50 and for increasing the pressure of the pumping fluid adjacent the outlet openings 34 or 52, whereby pumped fluid is drawn through the inlet openings 32 or 50 into the second passageway 44 or 44', carried along the second passageway 44 or 44', and forced out of the outlet openings 34 or 52 from the second passageway 44 or 44'.

Figure 4:
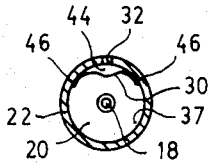
FIG. 4 is a sectional view of the pumping blocks shown in FIGS. 3 and 4 illustrating the arc segment of the diaphragm.

FIG. 4 broadly illustrates a cross sectional view of the pump block 22 and diaphragm 30 shown in FIGS. 2 and 3. The diaphragm 30 is shown defining the second passageway 44 which communicates with the inlet openings 32 or 50 and is caused to function by the continuous member 18 with the annular elements 20 being drawn through the first passageway 36 of the pumping block 31 forming pumping fluid sections 42 in the manner previously described.

Figure 5:
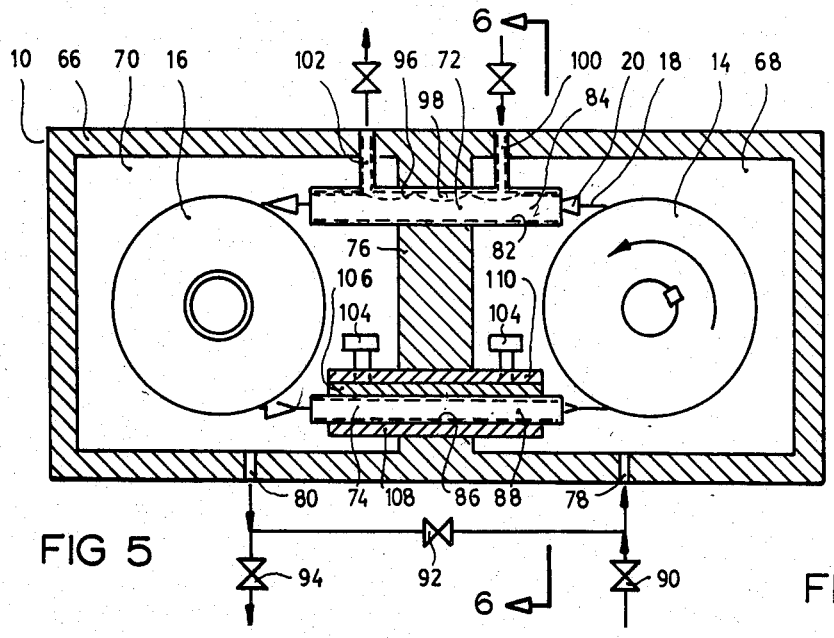
FIG. 5 is a plan sectional view of another preferred embodiment of the metering pump according to this invention in which a pump housing is separated into more than one fluid spaces with communication between these space by means of pumping blocks of different cross sectional areas.

Referring now to FIG. 5 there is shown a pump housing 66 defining first and second fluid spaces 68 and 70 with flow of fluid between these two spaces generally occurring through operation of first and second pumping blocks 72 and 74 while the apparatus 10 is in operation. The pumping blocks 72 and 74 are located in a wall 76 separating the first and second spaces 68 and 70. A first inlet opening 78 is operable to pass fluid into the first fluid space 68 and a first outlet opening 80 is operable to deliver fluid out of the second fluid space 70. The first pumping block 72 transfers fluid from the first fluid space 68 to the second fluid space 70 and the second pumping block 74 transfers fluid from the second fluid space 70 to the first fluid space 68 but at a slower rate than the first pumping block 72 is pumping fluid into the second space 70. In this manner, the second fluid space 70 is pressurized relative to the first fluid space 68 whereby fluid flows through the outlet opening 80 out of the second fluid space 70 and flows from a fluid source (not shown) through the inlet opening 78 into the first fluid space 68. The difference in transfer rate causing the pumping action described is preferably accomplished by having the first pumping block 72 configured with a wall 82 defining a first passageway 84 connecting the first fluid space 68 with the second fluid space 70, and by having the second pump block 74 configured with a wall 86 defining a passageway 88 with a smaller cross sectional area than the passageway 84 in the first pump block 72. The continuous member 18 having spaced-apart annular elements 20 as described above is operable to be drawn through the first passageway 84 in the first pump block 72 to transfer fluid from the first fluid space 68 to the second fluid space 70, and through the passageway 88 in the second pump block 74 to transfer fluid from the second fluid space 70 to the first fluid space 68. The spaced-apart annular elements 20 are dimensioned to sealingly engage the walls 82 and 86 of both the first and second pumping blocks 72 and 74. As shown in FIG. 5, the continuous member 18 and elements 20 are carried by the first and second sheaves 14 and 16 driven by a drive means external to the pump housing 66 to cause the continuous member 18 and spaced-apart annular elements 20 to move through the passageways 84 and 88.

The flow of fluid into the first fluid space 68 and out of the second fluid space 70 is regulated by means of inlet valve 90, outlet valve 94, and bypass valve 92. The first pump block 72 is configured with a diaphragm 96 attached to the wall 82 defining the first passageway 84 to provide a second passageway 98 extending along a portion of the length of the first passageway 84 as described in FIG. 3. Fluid is admitted from a fluid source into the second passageway 98 on the end of the first pumping block 72 extending into the first fluid space 68 by means of an inlet passageway 100. Fluid is delivered from the second passageway 98 at the end of the first pumping block 72 extending into the second fluid space 70 by means of an outlet passageway 102. The diaphragm 96 is formed from a flexible, fluid impermeable, membrane attached to the wall 82 defining the first passageway 84 in the first pumping block 72. The membrane of the diaphragm 96 is configured to be expandable into the first passageway 84 so that when the valves 90, 92 and 94 are configured to prevent external flow into and out of the first and second fluid spaces 68 and 70, the diaphragm 96 expands into the first passageway 84 to compensate for a decreased volume of fluid flowing through the first passageway 84 into the second fluid space 70 until it equals the volume of fluid flowing through the passageway 88 in the second pump block 74 into the first fluid space 68, whereby fluid is drawn through the inlet passageway 100 into the second passageway 98, carried along the second passageway 98, and forced out of the second passageway 98 through the outlet passageway 102.

Figure 6:
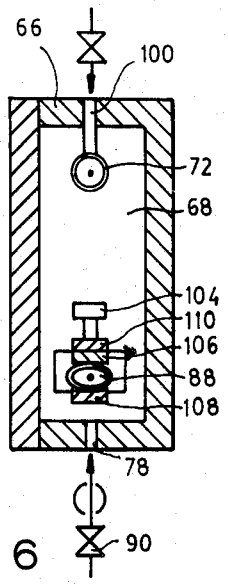
FIG. 6 is a sectional view of the embodiment shown in FIG. 5.

Referring to FIGS. 5 and 6, another aspect of the present invention is illustrated involving the use of a pair of adjustment screws 104 for deforming the wall 86 of the second pump block 74 to reduce the flow of fluid through the passageway 88 providing for adjustment of the volumetric flow exchange between the first fluid space 68 and the second fluid space 70. The part of the second pump block 74 forming the wall 86 is preferably constructed of a material such as polyethylene, polypropylene or the like, or a thin walled steel or composite metal tube, with the material adapted to be deformable in the manner shown in FIG. 6 to decrease the cross sectional area of the passageway 88 forming an oval or other shape, and to return to its original shape. The screws 104 act against a jacking plate 106 which deforms the pumping block 74 between the jacking plate 106 and a backing plate 108 which is attached to the wall 76 of the pump housing 66. The screws 104 are in threaded engagement with a second backing plate 110 which is also attached to the wall 76 of the pump housing 66. The wall 86 of the pumping block 74 assumes a different cross sectional area depending on the extent of deformation. The penetration and interstices of the pumping block 74 and jacking plate 106 through the wall 76 are sealed with a mastic material or some diaphragm means.

The present embodiments of the invention herein described in the specification and shown in the drawings are only illustrative. Many further modifications to the form and to the type of apparatus employing pump bodies, pumping blocks with various types and configurations of diaphragms to separate fluids used in the pumping functions, and the number and configuration of fluid spaces may be made to accommodate a variety of applications. Accordingly, although particular embodiments of the present invention have been described in the foregoing detailed description it will be understood that the invention is capable of numerous rearrangements, modifications and substitutions of parts without departing form the scope of the invention as set forth in the claims below.

What is claimed is:

1. An apparatus for metering small volumes of fluid, comprising:

a pump housing having a first fluid space and a second fluid space, and a wall separating said first fluid space from said second fluid space;

an inlet opening for passing fluid into said first fluid space;

an outlet opening for delivering fluid from said second fluid space;

first pump means located in said wall for pumping fluid from said first fluid space to said second fluid space; and second pump means located in said wall for pumping fluid from said second fluid space to said first fluid space at a slower rate than said first pump means is pumping fluid from said first fluid space to said second fluid space so that said second fluid space is pressurized relative to said first fluid space, whereby fluid flows through said outlet opening out of said second fluid space and through said inlet opening into said first fluid space.

2. An apparatus for metering small volumes of fluid, comprising:

a pump housing having a first fluid space and a second fluid space, and a wall separating said first fluid space from said second fluid space;

an inlet opening for passing fluid into said first fluid space;

an outlet opening for delivering fluid from said second fluid space;

first pump means located in said wall for pumping fluid from said first fluid space to said second fluid space;

second pump means located in said wall for pumping fluid from said second fluid space to said first fluid space at a slower rate then said first pump means is pumping fluid from said first fluid space to said second fluid space so that said second fluid space is pressurized relative to said first fluid space, whereby fluid flows through said outlet opening out of said second fluid space and through said inlet opening into said first fluid space;

said first and second pump means comprising first and second pump blocks, respectively, said first pump block having a wall defining a first passageway connecting said first fluid space and said second fluid space and said second pump block having a wall defining a passageway with a smaller cross sectional area than the cross sectional area of said first passageway in said first pump block for connecting said second fluid space and said first fluid space;

a continuous member having spaced-apart elements attached thereto, said continuous member and spaced-apart elements operable to be drawn through said first passageway in said first pump block to transfer fluid from said first fluid space to said second fluid space, and through said passageway in said second pump block to transfer fluid from said second fluid space to said first fluid space, said spaced-apart elements dimensioned to sealingly engage said walls of said passageways in said first and second pump blocks; and means for moving said continuous member and spaced-apart elements through the passageways in the first and second pump blocks.

3. The apparatus of claim 2, further comprising:

means for regulating the flow of fluid into said first fluid space and out of said second fluid space;

an elongate, flexible, fluid impermeable membrane attached to said wall defining said first passageway in said first pump block to provide a second passageway having opposite ends, said second passageway extending along at least a portion of the length of said first passageway;

means for admitting fluid from a fluid source into said second passageway towards one end of the second passageway;

means for delivering fluid from said second passageway spaced from said means for admitting towards the other end of said second passageway; and said membrane configured to be expandable into said first passageway in said first pump block so that when said means for regulating is configured to prevent flow of fluid into and out of said first and second fluid spaces, respectively, said membrane expands into said first first passageway to compensate for a decreased volume of flow of fluid through said first passageway into said second fluid space until it equals the volume of fluid flowing through said passageway in said second pump block into said first fluid space whereby fluid is drawn through said means for admitting fluid into said second passageway at one end, carried along said second passageway, and forced out of said second passageway through said means for delivering fluid from said second passageway at the other end.

4. The apparatus of claim 2, further comprising means for adjustably restricting the flow of fluid through said passageway in said second pump block to adjust the volumetric flow exchange between said first fluid space and said second fluid space.

5. The apparatus of claim 4, wherein said means for restricting comprises:

said wall defining said passageway in said second pump block being deformable generally along the length of said passageway; and means for adjustably deforming said wall to decrease the cross sectional area of said passageway.

6. In an apparatus for metering small volumes of fluids having wall means defining a first elongated passageway with open ends, pumping means in the first passageway including a plurality of spaced-apart members proportioned to sealingly engage the wall means defining the first passageway, means interconnecting the spaced-apart members, and means for moving the interconnecting means and its attached spaced-apart members through the first passageway, the improvement which comprises:

an elongate, flexible, fluid impermeable membrane in the first passageway having marginal edges sealably attached to the wall means defining the first passageway to provide a second elongated passageway extending along at least a portion of the length of the first passageway;

an inlet opening in the wall means defining the first passageway for connecting the second passageway with a source of fluid to be pumped;

a first outlet opening in the wall means defining the first passageway to deliver pumped fluid from the second passageway;

said inlet opening to said second passageway being positioned towards one end of the first passageway and, said first outlet opening from said second passageway being spaced from said inlet opening towards the other end of the first passageway;

means for supplying the first passageway with pumping fluid; and means for reducing the pressure of the pumping fluid between the spaced-apart members adjacent said inlet opening to said second passageway and means for increasing the pressure of the pumping fluid between the spaced-apart members adjacent said first outlet opening from said second passageway, whereby pumped fluid is drawn into said inlet opening to said second passageway, carried along said second passageway, and forced out of said first outlet opening from said second passageway.

7. The apparatus of claim 1, wherein the means for reducing the pressure and the means for increasing the pressure comprise a first transition area in the first passageway for increasing the cross sectional area of the first passageway adjacent said inlet opening to said second passageway and a second transition area in the first passageway for reducing the cross sectional area of the first passageway adjacent said first outlet opening from said second passageway, respectively.

8. The apparatus of claim 7, wherein said membrane is attached to extend from a point between the one end of the first passageway and said first transition area to a point between the other end of the first passageway and said second transition area.

9. The apparatus of claim 8, wherein the spaced-apart members are separated by a distance less than the distance between said inlet opening and said first outlet opening.

10. The apparatus of claim 1, wherein the means for reducing the pressure and the means for increasing the pressure comprise first pump means for withdrawing a portion of pumping fluid passing through the first passageway adjacent said inlet opening to said second passageway and second pump means for adding fluid the pumping fluid passing through the first passageway adjacent said first outlet opening from said second passageway, respectively.

11. The apparatus of claim 10, wherein said membrane is located to traverse the area of the first passageway extending from a point between the one end of the first passageway and said inlet opening to a point between the other end of the first passageway and said first outlet opening.

12. The apparatus of claim 10, further comprising:

a second outlet opening from said second passageway located toward the other end of the first passageway from said first outlet opening, said second outlet opening being separated from said second passageway by a distance greater than the distance between the spaced-apart members; and third pump means for adding fluid to the pumping fluid passing through the first passageway adjacent said second opening from said second passageway.

13. The apparatus of claim 12, wherein the membrane is attached to extend from a point between the one end of the first passageway and the inlet opening to a point between the other end of the first passageway and the second outlet opening.

* * * * *